US011029083B2

(12) United States Patent
Lux et al.

(10) Patent No.: US 11,029,083 B2
(45) Date of Patent: Jun. 8, 2021

(54) BEVERAGE DISPENSER AND REFRIGERATION APPLIANCE COMPRISING A BEVERAGE DISPENSER

(71) Applicant: BSH HAUSGERAETE GMBH, Munich (DE)

(72) Inventors: Denis Lux, Heidenheim (DE); Tobias Mayr, Bachhagel (DE); Elena Claass, Geislingen (DE); Andrea Fink, Gerstetten (DE); Jessica Dittmann, Herbrechtingen (DE); Armin Weber, Lauchheim (DE)

(73) Assignee: BSH Hausgeraete GmbH, Munich (DE)

( * ) Notice: Subject to any disclaimer, the term of this patent is extended or adjusted under 35 U.S.C. 154(b) by 120 days.

(21) Appl. No.: 16/461,411

(22) PCT Filed: Oct. 25, 2017

(86) PCT No.: PCT/EP2017/077233
§ 371 (c)(1),
(2) Date: May 16, 2019

(87) PCT Pub. No.: WO2018/091240
PCT Pub. Date: May 24, 2018

(65) Prior Publication Data

US 2019/0346198 A1 Nov. 14, 2019

(30) Foreign Application Priority Data

Nov. 16, 2016 (DE) ..... 102016222486.7

(51) Int. Cl.
*B67D 1/08* (2006.01)
*B67D 3/00* (2006.01)
*F25D 23/12* (2006.01)

(52) U.S. Cl.
CPC ..... *F25D 23/126* (2013.01); *B67D 1/0874* (2013.01); *B67D 3/0025* (2013.01); *B67D 3/0058* (2013.01); *F25D 2327/001* (2013.01)

(58) Field of Classification Search
CPC .. B67D 1/0874; B67D 1/0875; B67D 3/0025; B67D 3/0058; F25D 2327/001; F25D 27/00; F25D 23/126
See application file for complete search history.

(56) References Cited

U.S. PATENT DOCUMENTS 5,808,286 A * 9/1998 Nukui ..... G06K 7/10881 235/454
9,625,205 B2 4/2017 Becke et al.
(Continued)

FOREIGN PATENT DOCUMENTS

DE 102012216372 A1 3/2014
EP 2383531 A2 11/2011
(Continued)

*Primary Examiner* — Cassey D Bauer
(74) *Attorney, Agent, or Firm* — Laurence A. Greenberg; Werner H. Stemer; Ralph E. Locher

(57) ABSTRACT

A beverage dispenser has an actuation lever which is mounted in a dispenser recess in such a way as to be able to pivot about an axis, at least one lighting device, and at least one optical waveguide, which extends from the lighting device, for illuminating the dispenser recess. A light exit is provided on the actuation lever, and the optical waveguide connects the lighting device to the light exit on the actuation lever.

16 Claims, 6 Drawing Sheets

(56) References Cited

U.S. PATENT DOCUMENTS

| | | | | |
|---|---|---|---|---|
| 2003/0097314 | A1* | 5/2003 | Crisp, III | B67D 1/0021 705/28 |
| 2005/0044871 | A1 | 3/2005 | Nowak | |
| 2011/0174008 | A1 | 7/2011 | Kim | |
| 2012/0031124 | A1 | 2/2012 | McDaniel | |
| 2012/0180517 | A1* | 7/2012 | Filho | F25D 27/00 62/389 |
| 2016/0209105 | A1* | 7/2016 | Grzyb | F25D 23/04 |

FOREIGN PATENT DOCUMENTS

| | | | |
|---|---|---|---|
| EP | 3045848 | A1 | 7/2016 |
| KR | 20090106933 | A | 10/2009 |
| WO | 2016052857 | A1 | 4/2016 |

* cited by examiner

BEVERAGE DISPENSER AND REFRIGERATION APPLIANCE COMPRISING A BEVERAGE DISPENSER

BACKGROUND OF THE INVENTION

Field of the Invention

The present invention relates to a beverage dispenser and a refrigeration appliance, in particular a household refrigeration appliance, in which such a beverage dispenser is installed.

An essential part of most beverage dispensers is a dispenser recess, which is a component in the form of a box which is open on a front face and which is mounted in a recessed manner in a thermally insulating outer wall of the refrigeration appliance, so that its open front face forms an indentation in the outer wall, into which a receptacle may be introduced in order to fill said receptacle via an outlet arranged at the top of the dispenser recess.

Since during use of the beverage dispenser the dispenser recess is obscured by a user standing in front thereof, the dispenser recess is generally provided with an illuminating means. Thus a beverage dispenser is disclosed, for example, in EP 3 045 848 A1 in which a printed circuit board populated with LEDs is arranged to the rear of a front wall above the dispenser recess and the dispenser recess is illuminated by an optical waveguide which captures light from the LEDs and terminates at the top of the dispenser recess on either side of the outlet.

In this conventional beverage dispenser, sufficient space for the outlet aperture of the optical waveguide is present at the top of the dispenser recess since the dispenser recess is designed to be sufficiently wide in order to receive receptacles to be filled in all common household widths, but the outlet is considerably narrower than the recess. If, however, the space on either side of the central outlet at the top of the dispenser recess is required for other purposes, then a different means has to be found in order to illuminate the interior of the dispenser recess. This problem arises, in particular, when the space at the top of the dispenser recess is occupied by a plurality of outlets, and control elements assigned to the outlets are arranged adjacent to one another on a rear wall of the dispenser recess, since in this case the respective receptacle has to be suitably positioned in order to actuate one of the control elements in an accurate manner.

SUMMARY OF THE INVENTION

It is the object of the invention, therefore, to provide a beverage dispenser which permits simple illumination of the dispenser recess without occupying space therefor at the top of the dispenser recess.

In a beverage dispenser comprising an actuation lever which is mounted in a dispenser recess in such a way as to be able to pivot about an axis, at least one lighting means and at least one optical waveguide which extends from the lighting means for illuminating the dispenser recess, the object is achieved by a light exit being provided on the actuation lever and the optical waveguide connecting the lighting means to the light exit of the actuation lever.

So that the light of the lighting means is able to reach the light exit on a short path without losses, the lighting means is preferably arranged on a rear wall of the dispenser recess covered by the actuation lever.

If the actuation lever is articulated in a manner known per se on a base mounted on the wall, the assembly of the beverage dispenser may be simplified by the optical waveguide also being fastened to the base. In particular, the optical waveguide or a holder of the optical waveguide may be integrally molded with the base.

Since such an integral implementation facilitates the discharge of light from the optical waveguide into the base and makes it difficult to guide the light accurately to the positions of the dispenser recess where it is required, according to a preferred embodiment the base and the optical waveguide are configured in two parts. In order to simplify the assembly of the base and the optical waveguide, the base may be a hollow body which is open toward a rear wall of the dispenser recess, one wall thereof having an edge facing the rear wall and at least one recessed portion toward the edge, said recessed portion being open on the edge thereof. The optical waveguide may be mounted in this recessed portion by being inserted from the edge.

The base may thus be produced from an opaque plastics material which generally is more cost-effective than a colorless plastics material which is used for the optical waveguide; moreover, the need to provide the base with a coating in order to prevent the escape of light at undesired points is dispensed with.

In order to increase the output of light at the light exit of the actuation lever, the light exit and a rough surface, which scatters the light dissipated in the actuation lever, oppose one another on two sides of the actuation lever. The rough surface may, in particular, be fluted and namely preferably transversely to the direction of diffusion of the light in the actuation lever.

The actuation lever may have a first lever arm which extends downwardly from the axis and a second lever arm which protrudes from the axis into the recess, in particular in order to actuate a beverage outlet by its movement. Information such as above and below always refer in this case and hereinafter to the usual installed position of the beverage dispenser in a refrigeration appliance.

A lower light exit may be provided on a lower face of the second lever arm.

Preferably this lower light exit is positioned such that the first lever arm is illuminated via the light exit and/or a receptacle which is held against the first lever arm to be filled is directly illuminated therein from above.

Alternatively, the second lever arm may be configured to be self-illuminating by at least one lower light exit being provided on the first lever arm. This is expedient, in particular, if the beverage dispenser comprises a plurality of outlets with assigned actuation levers and it is important when a receptacle is inserted into the dispenser recess to strike the respectively desired actuation lever and only this actuation lever.

If the first lever arm is plate-shaped in order to simplify the positioning of the receptacle on the lever arm, the lower light exit may extend along an edge of the plate or may be arranged at a central point of the first lever arm.

Moreover, an upper light exit may be provided on an upper face of the second arm or the base. Such a light exit, in particular by reflection at the top of the dispenser recess, may also illuminate this dispenser recess around a receptacle held therein.

This permits a comprehensive illumination of the dispenser recess, in particular even if the top of the dispenser recess, against which the light emerging from the upper light exit radiates, is a lower face of a disposable beverage container.

If this lower face is transparent, the reflected light may be colored by the beverage which is located in the beverage container, so that the color with which the dispenser recess is illuminated permits information to be provided about the beverage and helps to prevent a different beverage being dispensed from that which is desired.

If the upper light exit is aligned with a wall of the beverage container the light in the wall may be dissipated across a long distance in the wall without losses, and by being distributed over the wall surface the light may be transmitted into a beverage stored in the container, and if it has the relevant cloudiness permit said beverage to be illuminated. In order to capture the light without losses, a rib may be formed in the wall. In order to control the transfer of light into the beverage, the cross section of the rib may decrease as the distance from the light exit increases.

If the actuation lever is produced from a translucent material provided with an opaque coating, a light exit may be formed by a hole in the opaque coating, for example by an initially opaque coating applied over the entire surface being locally removed again, for example by laser ablation.

The opaque coating may comprise an internal and an external layer, wherein the internal layer should be brighter than the external layer in order to conduct the light in the actuation lever to the outlet opening with the fewest losses.

If the second arm is hollow, the optical waveguide may terminate in a hollow space of the second arm spaced apart from the light exit. Thus the optical waveguide does not need to follow movements of the actuation lever, which simplifies the assembly of the dispenser.

If, as described above, a lower light outlet opening is provided on the first lever arm, in order to supply the lower light outlet opening with light the translucent material may be exposed on an edge of the first lever arm facing the axis of the actuation lever, and the optical waveguide terminates opposite the edge in order to supply its light via this edge into the lever arm.

In order to guide the light supplied via the edge to the lower light exit with low losses, the first lever arm may comprise a rib which protrudes from a base plate of the lever arm and extends from the end of the optical waveguide to the lower light exit. By guiding the substantial part of the light emitted by the optical waveguide, the rib prevents the light from being distributed in the width direction of the base plate and as a result prevents it from falling short of the lower light exit. The above-mentioned rough surface may be an edge of the rib remote from the base plate.

If the dispenser recess is defined by a housing which is fitted into a thermally insulating wall of the refrigeration appliance and which is open toward an outer face of the wall, a beverage container may be inserted into an upper face of the housing which is open toward the inner face of the wall.

In particular, if as described above the light of the lighting means is also supplied into the walls of the beverage container, the thermally insulating wall of the refrigeration appliance is designed to have an aperture through which an illuminated part of the container is visible from the outside.

Further features and advantages of the invention are disclosed from the following description of exemplary embodiments with reference to the accompanying figures, in which:

DESCRIPTION OF THE INVENTION

Figure 1:
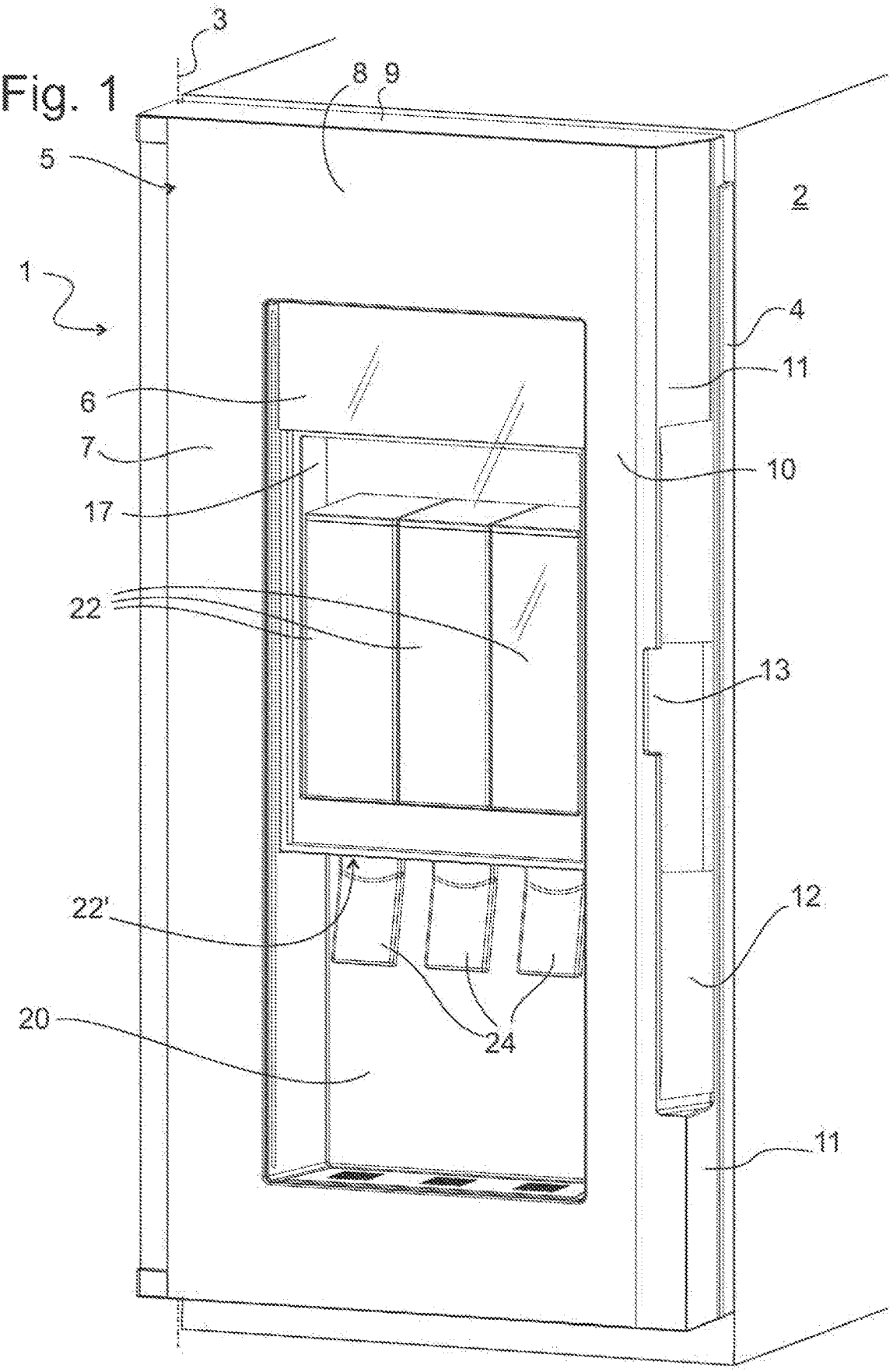
FIG. 1 shows a perspective external view of a door subassembly of a refrigeration appliance according to the invention.

In FIG. 1 a door subassembly 1 and a body 2, shown only partially, form a housing of a household refrigeration appliance which surrounds a storage compartment for refrigerated goods. The door subassembly 1 is pivotably articulated on the body 2 about an axis 3.

The door subassembly 1 comprises a door 4, in the narrower sense closing the storage compartment, and a cover 5 which is pivotable relative to the door 4 about the same axis 3. In the view of FIG. 1 the door 4 is largely concealed by the cover 5.

The cover 5 comprises a window pane 6 made of clear or tinted glass or plastics material, in this case enclosed by a non-transparent frame 7. An upper strip of the frame 7 is L-shaped in section with a limb 8 extending vertically upwardly from the window pane 6, and a limb 9 angled back from an upper edge of the limb 8 toward the body 2, and extending across an upper flank of the door 4. Correspondingly, a right-hand strip of the frame comprises a limb 10 extending from the right-hand edge of the window pane 6 in the width direction of the door subassembly 1, and a limb 11 which is angled back toward the body and which, however, is divided into two by a handle recessed portion 12 into an upper and a lower half. A central piece 13 of the handle recessed portion 12 extends from the edge into the limb 10.

Figure 2:
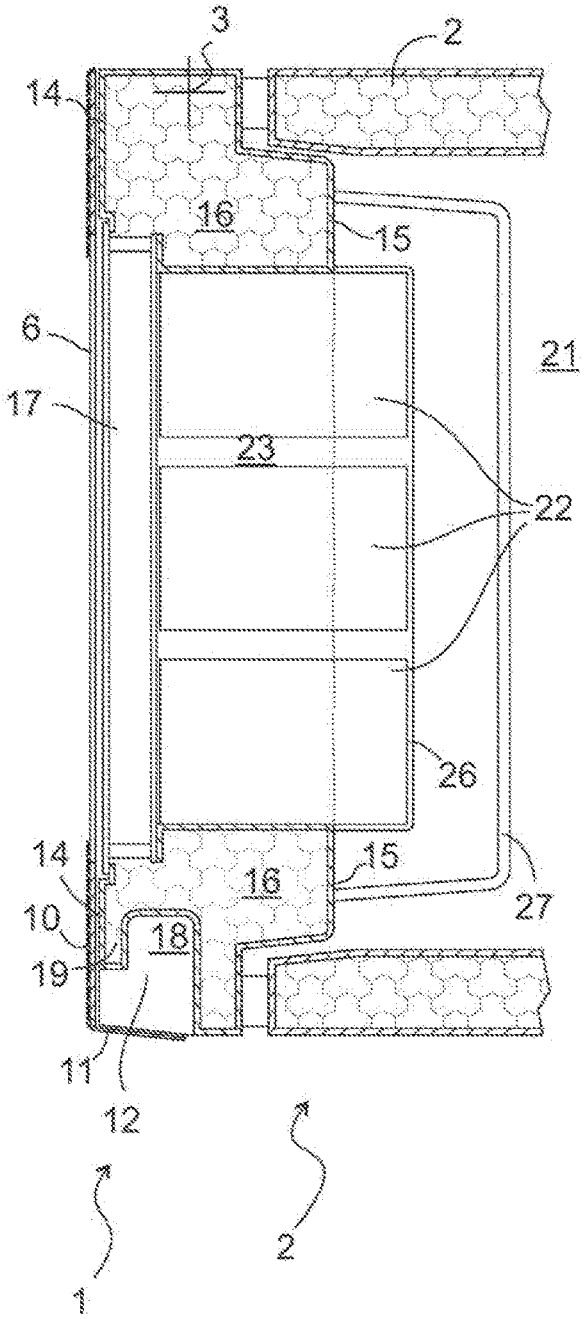
FIG. 2 shows a horizontal section through the door subassembly, level with the beverage containers mounted therein

FIG. 2 shows a horizontal section through the door subassembly 1 along a plane which extends level with the handle recessed portion 12 just above the central piece 13. The door 4 comprises in the conventional manner fixed outer and inner walls 14, 15 which are connected along their edges in order to form a hollow space filled with thermally insulating foamed material 16. Here in each case an opening is cut out of the outer and inner wall 14, 15, into which an insulating glass pane 17 is inserted and sealingly connected to the walls 14, 15. A laterally open handle groove 18 is cut out of a lateral flank of the door 4. On its side facing the cover 5, the handle groove 18 is defined by a projection 19. The limb 10 of the cover protrudes laterally over the projection 19 so that a user who grips the handle recessed portion 12 level with the cutting plane of FIG. 2 manages to grip the limb 10 of the cover 5 but not necessarily the projection 19 of the door 4, so that when the user pulls the limb 10 toward himself the cover 5, rather than the door 4, pivots about the axis 3.

Figure 3:
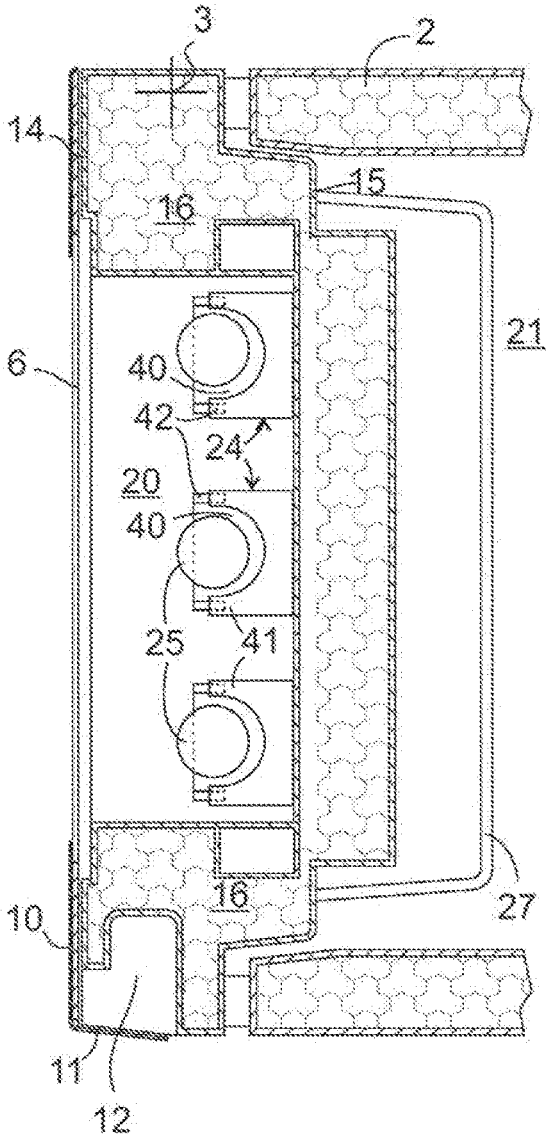
FIG. 3 shows a section through the door subassembly, level with a dispenser recess.

By pivoting solely the cover 5 about the axis 3, a dispenser recess 20 is accessible, said dispenser recess having been cut out of a lower part of the door 4 and being shown in FIG. 3 in a horizontal section through the door subassembly 1.

Level with the central piece 13, however, the edge of the limb 10 is flush with the projection 19 so that a user grips the handle groove 18, acting at the level of the central piece, and thus pivots the entire door subassembly 1 about the axis 3 and a storage compartment 21 for refrigerated goods in the interior of the body 2 is accessible.

FIG. 2 shows in section a plurality of beverage containers 22 which are accommodated in a recess 23 which is defined by the insulating glass pane 17 and by flanks of the inner wall 15 of the door 4 adjacent thereto, and which is open toward the storage compartment 21.

As may be identified in FIG. 1 the beverage containers 22 are visible through the insulating glass pane 17 and the window pane 6. The lower faces 22' of the beverage containers 22 are open at the top of the dispenser recess 20. The beverage containers 22 may be provided with a text which denotes the contents thereof and which is visible through the panes 6, 17. Preferably, the beverage containers 22 are produced from a transparent plastics material so that the color and filling state of their contents are visible through the panes 6, 17.

One respective actuation lever 24 is mounted below each beverage container 22 in the dispenser recess 20, said actuation lever, in a manner to be described in more detail below, serving to open a valve 25 on the lower face 22' of the beverage container 22 arranged there above, if a receptacle is pressed against the actuation lever 24 in the dispenser recess 20, and serving to fill the receptacle with a beverage from the container 22.

Figure 4:
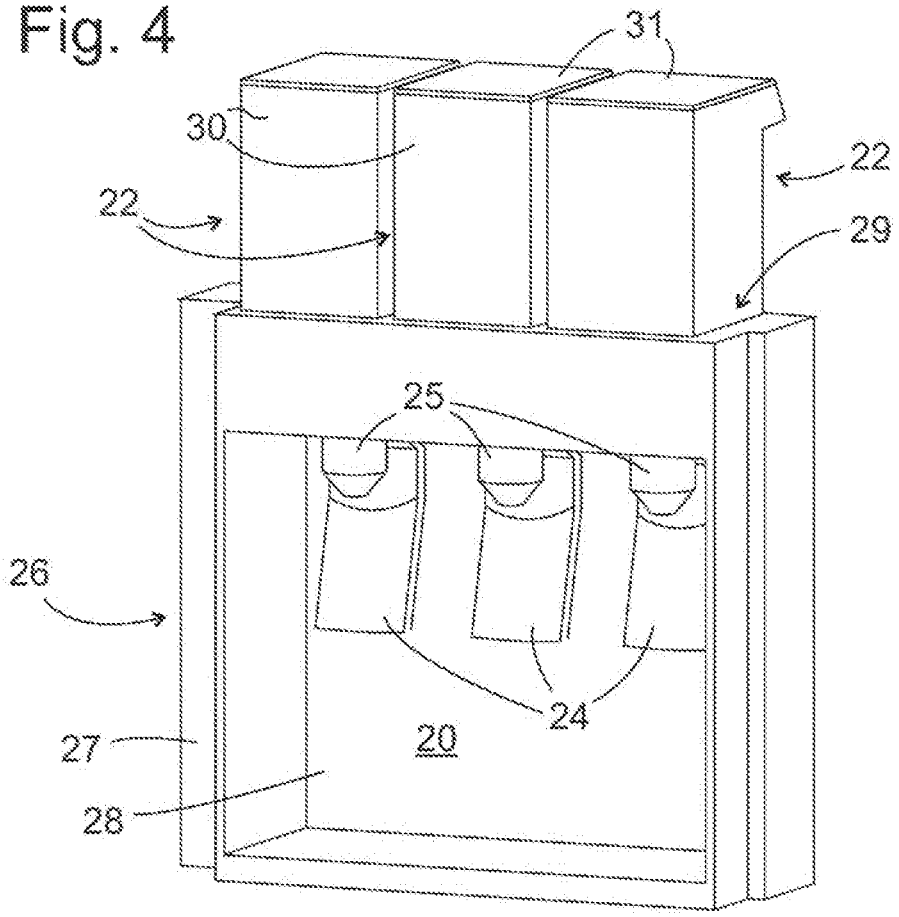
FIG. 4 shows a perspective view of the dispenser of the door subassembly of FIG. 1.

FIG. 4 shows the dispenser without the surrounding door 4 in a perspective view which corresponds approximately to that of FIG. 1. The dispenser recess 20 is defined by an approximately cuboidal housing 26 which is injection-molded from plastics material and which is generally assembled from a plurality of molded parts. The housing has on its front face 27 an opening 28 which in the installed state is open on the front face of the door 4 and forms the entry to the dispenser recess 20. An upper face 29 of the housing 26 is also open; the beverage containers 22 being guided therein from above as far as a stop.

The beverage containers 22 are substantially cuboidal. The beverage containers comprise in each case a container lower part 30 which is preferably formed from glass-clear plastics material, the upper face thereof being closed by a lid 31 and the valve 25 being releasably mounted on the lower face thereof.

The valves 25 and the actuation levers 24 are visible through the opening 28 in FIG. 4.

Figure 5:
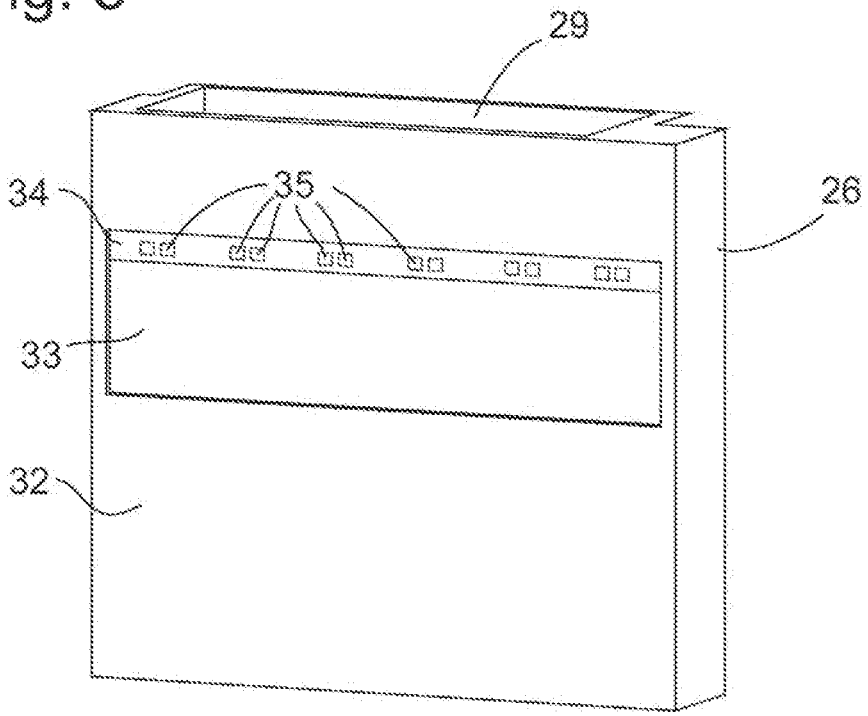
FIG. 5 shows a housing of the dispenser in a rear view.

FIG. 5 shows the housing 26 in a view from the opposing direction from the side of the storage compartment 21. The containers 22 are omitted in this view, so that the large-surfaced open upper face 29 is clearly visible. An aperture 33 is cut out from a rear wall 32 of the housing 26 opposing the open front face 27. A printed circuit board 34 is mounted in the aperture 33, said printed circuit board extending in the transverse direction across all three containers 22. A set of LEDs 35 is assigned to each container 22 on the printed circuit board 34, said LEDs being indicated in dashed lines in FIG. 5 since they are located on the front face of the printed circuit board 34 remote from the observer. In the case shown here, each set comprises four LEDs 34, in each case two on each side of the actuation lever 24 assigned to the container 22.

Figure 6:
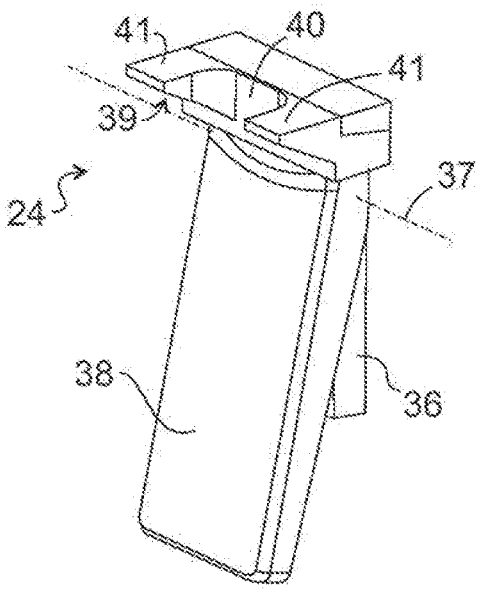
FIG. 6 shows an actuation lever according to a first embodiment of the dispenser in a front view.

FIG. 6 shows one of the actuation levers 24 in an enlarged perspective view. The actuation lever 24 is pivotably mounted on a base 36 about a horizontal axis 37. A first lever arm 38 extends from the axis 37 steeply downwards and to the front into the dispenser recess 20, a second lever arm 39 extends from the axis 37 substantially horizontally to the front. The lever arm 39 is bifurcated by a cut-out 40 which is open to the front and into which the valve 25 of the container 22 arranged thereabove engages, as may be identified in FIG. 3.

The actuation lever 24 in FIG. 6 is shown in a resting position. From this resting position the first lever arm 38 may be forced back against the base 36 counter to the force of a restoring spring, not shown, which is inserted between the actuation lever 24 and the base 36. At the same time, as a result two fingers 41 of the second lever arm 39 on either side of the valve 25 move downwardly and open said valve by pulling actuating projections 42 (see FIG. 3) of the valve 25 downwardly therewith.

Figure 7:
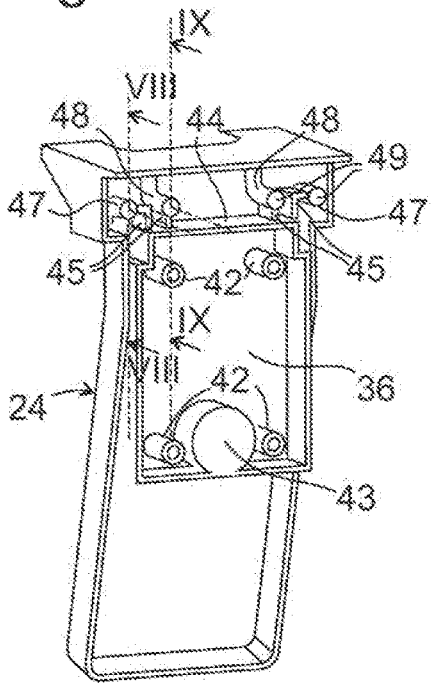
FIG. 7 shows the actuation lever of FIG. 6 in a rear view.

As is clear in FIG. 7 both the base 36 and the actuation lever 24 are hollow bodies. The base and actuation lever are open toward the rear wall 32 of the housing 26 without undercuts and therefore may be injection-molded in a simple and cost-effective manner from plastics material. The base 36 has substantially the shape of a planar cuboid, one of the main sides being open and facing the rear wall 32 and/or in the view of FIG. 7 the observer. In the hollow interior of the cuboid screw domes 42 are formed for anchoring the base 36 to the rear wall 32. Moreover, a recessed portion 43 formed on the front face of the base 36 facing the actuation lever 24 is illustrated, said recessed portion receiving the restoring spring.

A plurality of ribs 45 protrude from an upper narrow side 44 of the base 36, in each case optical waveguides 47, 48 are attached to the ends thereof. Each optical waveguide 47, 48 has an inlet aperture 49 which opposes one of the LEDs 35 on the printed circuit board 34. Adjoining the inlet aperture 49, the optical waveguides 47, 48 in each case are oriented perpendicular to the rear wall 32 and/or to the printed circuit board 34 and the LEDs 35, in order to capture as fully as possible the light radiated by the LEDs substantially perpendicular to the printed circuit board 34. The ends of the optical waveguides remote from the rear wall 32 are curved downwardly in the case of the optical waveguide 47 and curved upwardly in the case of the optical waveguide 48.

In the case of FIG. 7 in each case a downwardly curved optical waveguide 47 and an upwardly curved optical waveguide 48 are arranged to the right and left of a central plane of the base 36. Naturally it might also be conceivable to provide only upwardly curved or only downwardly curved optical waveguides or respectively only one upwardly curved optical waveguide on one side of the central plane and one downwardly curved optical waveguide on the other side of the central plane.

In the simplest case, the optical waveguides 47, 48 are bars made of a uniform transparent plastics material and injection-molded integrally with the ribs 46 and the base 36.

The fact that in this case the base 36 also consists of transparent plastics material is barely noticeable to an observer since the base 36 in the interior of the dispenser recess 20 is fully concealed behind the actuation lever 24. Light losses via the ribs 46 are thus not able to be entirely avoided but may be kept small by a narrow width of the ribs 46.

Optical waveguides 47, 48 with lower losses could be formed by bundles of optical fibers onto which the ribs 46 and the base 36 are injection-molded.

Figure 8:
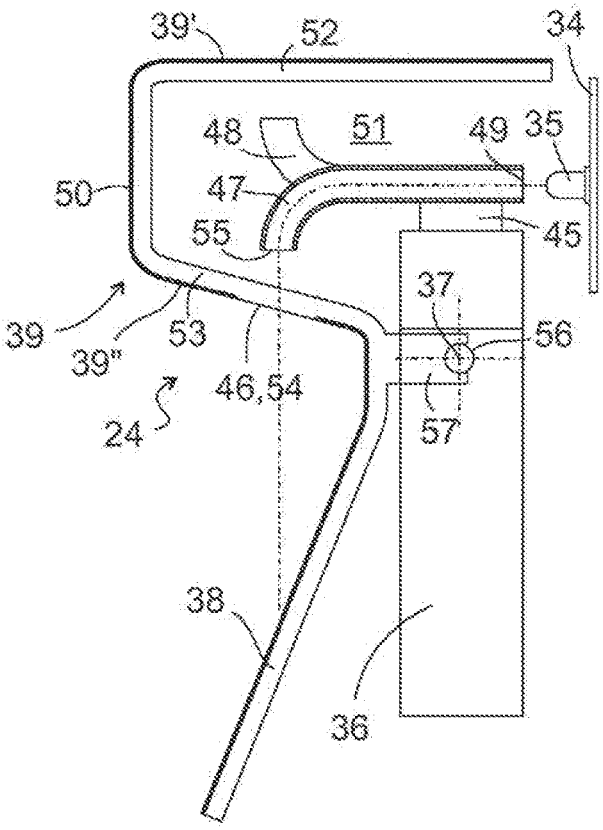
FIG. 8 shows a section through the actuation lever along the plane VIII-VIII of FIG. 7.

FIG. 8 shows a section through the base 36, the actuation lever 24 and the printed circuit board 34 in the plane VIII-VIII of FIG. 7 extending along the optical axis of one of the two optical waveguides 47. The actuation lever 24 is injection-molded from transparent plastics material and on at least one side, in this case the outer face facing the dispenser recess 20, is covered with an opaque coating 50. The lever arm 39 of the actuation lever 24 is hollow; the upper and lower face 39', 39" of the lever arm 39 in each case are formed by a wall 52 and/or 53 which enclose a hollow space 51.

The optical waveguide 47 extends in the hollow space 51 without being in contact with the upper and lower wall 52 and/or 53 thereof. As a light exit 46 via which the light of the LEDs 35 passes into the dispenser recess 20, a hole 54 is formed on the lower wall 53 in the opaque coating 50 which opposes an outlet aperture 55 of the optical waveguide 47 so that the light which emerges from the optical waveguide 47 substantially fully strikes the outlet aperture 55 and illuminates the outer face of the lever arm 38 located therebelow and/or, if present, a receptacle pressed against the lever arm 38.

FIG. 8 further shows an axle pin 56 which protrudes from a side wall of the base 36 and which is latched into a recessed portion on a side wall 57 of the actuation lever 24 in order to define the axis 37.

Figure 9:
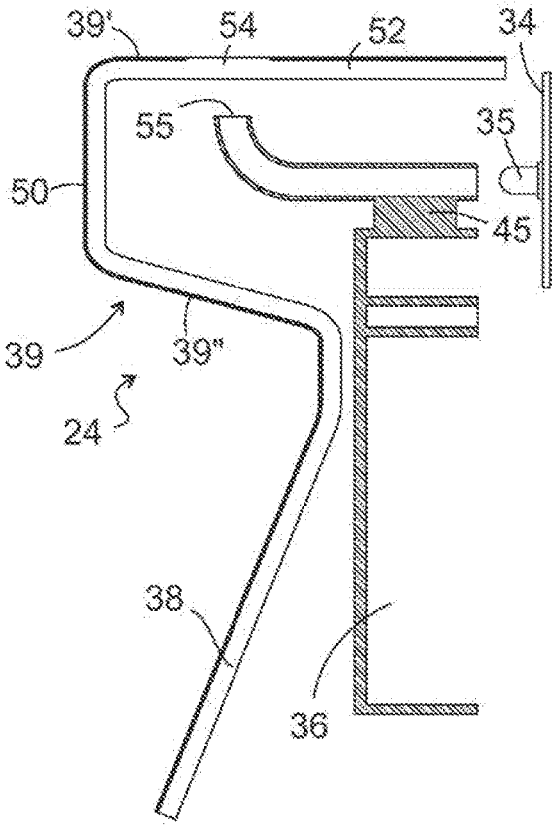
FIG. 9 shows a section through the actuation lever along the plane IX-IX of FIG. 5.

FIG. 9 shows a second section through the base 36, the actuation lever 24 and the printed circuit board 34 in the plane IX-IX of FIG. 7 which extends along the optical axis of one of the upwardly curved optical waveguides 48. In this case, a hole 54 in the opaque coating 50 of the upper wall 52 opposes the outlet aperture 55 of the optical waveguide 48. The spacing between the outlet aperture 55 and the wall 52 is sufficiently large that the optical waveguide 48 does not come into contact with the wall 52 even if the lever arm 38 bears against the base 36.

Light which passes through the hole 54 of the upper wall 52, strikes the lower face of the container 22 located thereabove and is reflected back thereby into the dispenser recess 20.

The transparent layer of the walls 52, 53 in FIG. 8 and FIG. 9 in each case has a thickness which remains the same across the entire extent of the hole 54, so that the light passes through the holes 54 without altering its direction. However, it might also be conceivable to form the walls 52, 53 in the region of the holes 54 as prisms, in order to direct the light in a desired direction, in the case of reduced curvature of the optical waveguides 47, 48, or to form lenses in the walls 52, 53 in particular in order to fan out bundled light emerging from the optical waveguides 47, 48, and thus to illuminate the dispenser recess 20 uniformly.

Figure 10:
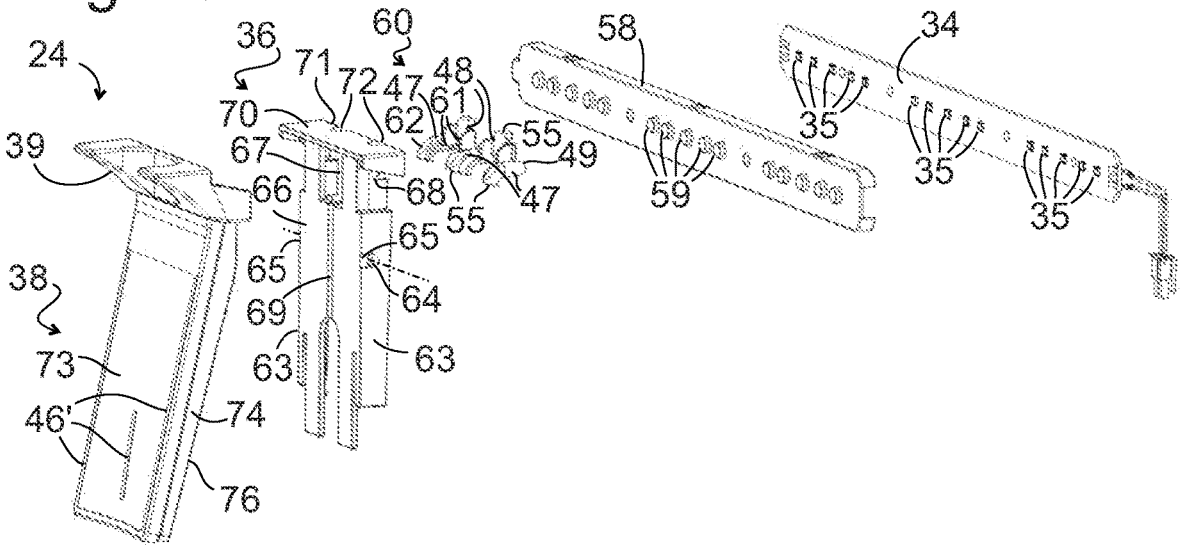
FIG. 10 shows parts of a beverage dispenser according to a second embodiment in an exploded view.

FIG. 10 shows parts of a beverage dispenser according to a second embodiment in an exploded view. The beverage dispenser is provided as described above for installation in a refrigeration appliance as shown in FIGS. 1 to 5. One of the parts shown in FIG. 10 is a printed circuit board 34 populated with a plurality of sets of LEDs 35. Each of set of LEDs 35 is assigned to an actuation lever 24. The beverage dispenser considered here, as shown in FIG. 4, has three actuation levers 24 (only one thereof being shown in FIG. 10); and accordingly three sets of LEDs 35 are present on the printed circuit board 34.

A housing 58 is provided in order to receive the printed circuit board 34. Each of the numerous openings 59 of the housing 58 opposes one of the LEDs 35 in order to permit the light thereof to pass through to an optical waveguide 47 or 48.

Here the sets comprise in each case five LEDs 35.

The housing 58 and the printed circuit board 34 are provided in order to be mounted on the rear face, i.e. the side facing the storage compartment 21, of the rear wall 32 of the dispenser recess, not shown in FIG. 10.

Optical waveguides 47, 48 made of glass-clear plastics opposing the LEDs 35 are connected by projections 61 to form an integral molded part 60. The optical waveguides 47, 48 comprise in each case inlet apertures 49 facing one of the LEDs 35 and/or one of the openings 59, and alternately upwardly and downwardly oriented outlet apertures 55. In order to deflect light passed via the inlet apertures 49 into the optical waveguides 47, 48 to the outlet aperture 55 the optical waveguides 47, 48 may have fully reflective planar surfaces 62 between the inlet and outlet.

FIG. 10 also shows a base 36 which serves as a holder for the actuation lever 24 on the front face of the rear wall 32. The base 36 is a hollow, approximately cuboidal molded part made of plastics material which is open on its rear face, in the mounted state facing the rear wall 32 of the dispenser recess. Indentations 64 are formed on the lateral flanks 63 of the base 36, said indentations opposing one another and receiving axle pins (not visible in the Fig.) of the actuation lever 24 and thus fixing an axis 37 about which the actuation lever 24 is pivotable relative to the base 36.

The indentations 64 in each case are located at the end of a groove 65 which extends from a front face 66 of the base 36 horizontally via the flanks 63, so that the actuation lever 24 may be easily latched from the front onto the base 36 by its axle pins initially being inserted into the grooves 65 and pushed therein to the rear until latched in the indentations 64.

In the vicinity of its upper end, the base 36 has a through-passage 67 through which in the assembled state the central optical waveguide 47 of the molded part 60 extends. The lateral flanks 63 of the base 36 in each case extend between the central optical waveguide 47 and the two outer optical waveguides 47 and in each case are provided with a horizontal notch 68. The notches 68 in the assembled state receive horizontal portions of the projections 61 and thus fix the molded part 60 in the vertical direction.

A groove 69 extends vertically downwardly in the base 36 starting from the through-passage 67.

Two recessed portions 72 are formed in an upper wall 70 of the base 36, starting from an edge 71 facing the rear wall 32 of the dispenser recess, said recessed portions receiving the outlet apertures 55 of the optical waveguides 48 in a flush-mounted manner.

The actuation lever 24 comprises a second lever arm 39 protruding above the axis 37 into the dispenser recess and a first lever arm 38 extending obliquely downwardly. The first lever arm 38 comprises a base plate 73 and ribs 74 protruding from a side of the base plate 73 facing the rear wall 32. If the actuation lever 24 is mounted on the base, two of the ribs 74 encompass the flanks 63 of the base 36 and bear the axle pins engaging in the recessed portions 64 thereof. A further rib 74 is received in the groove 69. In each case opposite the ribs 74 slotted light exits 46' are formed on a front face of the base plate 73.

Figure 11:
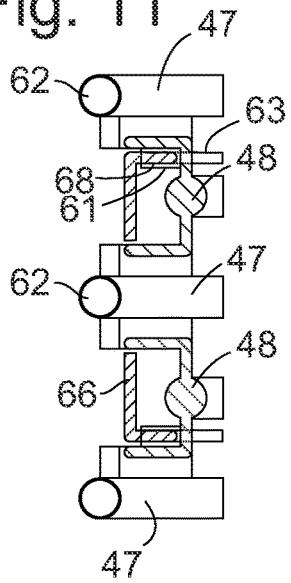
FIG. 11 shows a horizontal section through the actuation lever, the base and the optical waveguide of FIG. 10 in the assembled state.

FIG. 11 shows a horizontal section through the molded part 60 and the base 36 in the assembled state. Above the notches 68 the cutting plane intersects the upwardly oriented optical waveguides 48 and the vertical portions of the projections 61 connecting the optical waveguides 47, 48.

Figure 12:
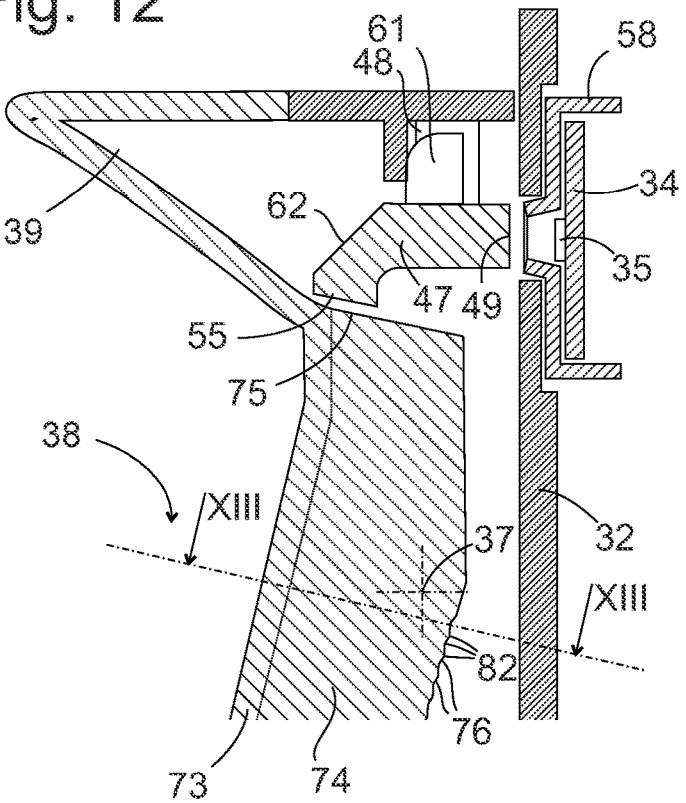
FIG. 12 shows a vertical section through the beverage dispenser according to the second embodiment.

FIG. 12 shows a section through the parts shown in FIG. 10 in the assembled state along a plane perpendicular to the axis 37 and extending through the central optical waveguide 47. The housing 58 with the printed circuit board 34 and the base 36 bear against opposing sides of the rear wall 32. Of the actuation lever 24, the second lever arm 39 and a part of the first lever arm 38 may be identified. The second lever arm 38 is hollow. The first lever arm 38. only appears to be more solid than the second lever arm since the cutting plane extends along the central rib 74, the wall thickness of its base plate 73 corresponding substantially to that of the first lever arm 38.

An upper edge of the base plate 73 and an upper end 75 of the central rib 74 oppose the outlet aperture 55 of the central optical waveguide 47 so that light escaping at this point is largely absorbed by the rib 74 molded from glass-clear plastics material and is conducted downwardly along the rib 74 in the lever arm 39. An edge of the rib 74 remote from the base plate 73 is roughened by a fluted contour. Edges 82 of this fluted contour extend parallel to the axis 37 and transversely to the direction of the dissipation of the light in the ribs 74 so that light which strikes the facets 76 defined by these edges 82 is reflected in the direction of the base plate 73 and thus the output of light via the light exit 46' (below the cutout shown in FIG. 12) is facilitated.

In FIG. 10 it may be identified that the second lever arm 39 is slightly wider than the first lever arm 38. As a result, it is also possible to place the outlet aperture 55 of the two outer optical waveguides 47 inside the lever arm 38 over the ends of the outer ribs 74 and thus supply light into the outer ribs 74.

Figure 13:
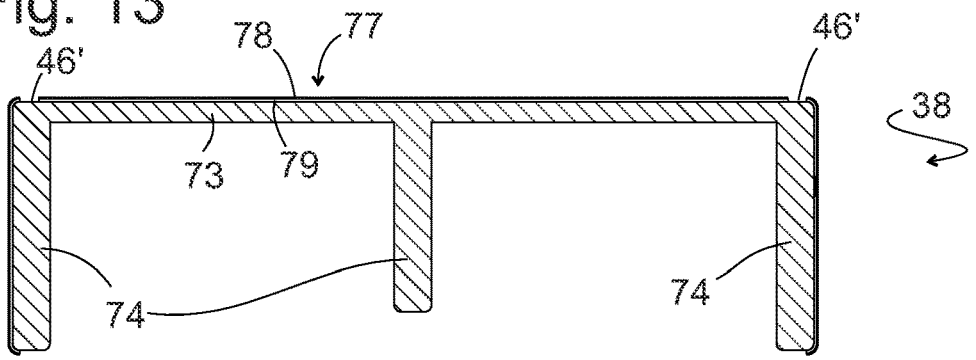
FIG. 13 shows a section through an arm of the actuation lever.
Figure 14:
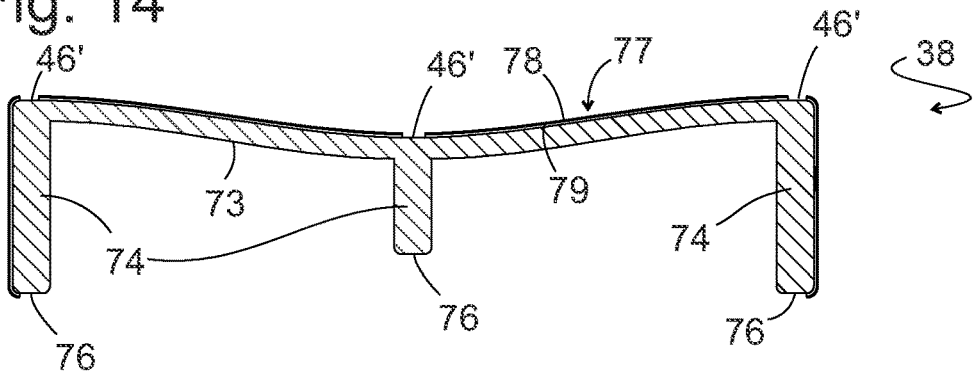
FIG. 14 shows a further section through the arm.

FIGS. 13 and 14 show in each case sections through the first lever arm 38. The cutting plane of FIG. 13 is denoted in FIG. 12 by XIII-XIII and that of FIG. 14 is located below the cut-out shown in FIG. 12. In each case the base plate 73 and the ribs 74 protruding therefrom are identified. An opaque coating 77 covers the lateral flanks of the two outer ribs 73 and the front face of the base plate 73, with the exception of the light exits 46' which are aligned with the two outer ribs 74. The coating 77 comprises an outer layer 78 in any color blending with the coloration of the dispenser recess. An internal layer 79 of the coating 77 is white in order to minimize absorption of the light dissipated in the ribs 74 by being absorbed on the coating 77.

In FIG. 14 a light exit 46' opposes the central rib 74. The height of the ribs 74 decreases as the distance increases from the axis 37. The front face of the base plate 73 is concave in FIG. 14 in order to provide a hold for filling the container pressed thereagainst in the lateral direction and to prevent the container from slipping on a laterally adjacent actuation lever 24.

Figure 15:
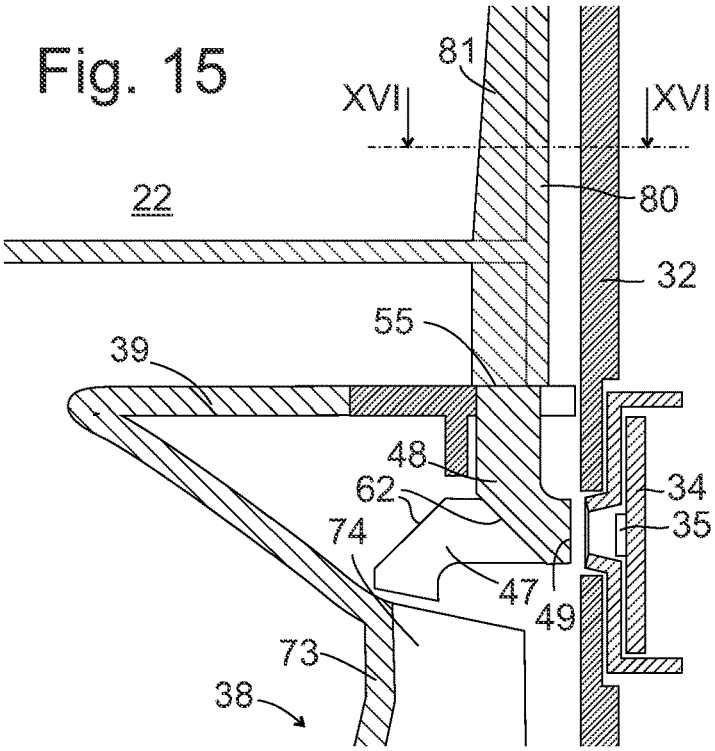
FIG. 15 shows a second vertical section through the beverage dispenser according to the second embodiment.
Figure 16:
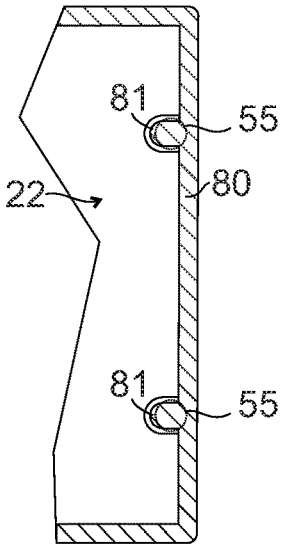
FIG. 16 shows a section through a wall of a beverage container supplying the beverage dispenser.

FIG. 15 shows as in FIG. 12 a section along a plane perpendicular to the axis 37, but the plane of FIG. 15 runs through one of the optical waveguides 48, the outlet aperture 55 thereof in each case being located in the upper wall 70 of the base 36. A vertical side wall 80 of the beverage container 22 is supported on this wall 70. In order to absorb as fully as possible the light of the optical waveguide 48, the side wall 80, as shown in FIG. 16 with reference to a horizontal section along the plane XVI-XVI of FIG. 15, in a similar manner to the base plate 73 is reinforced by a rib 81 protruding into the interior of the beverage container 22. The cross section of the rib 81 reduces as the distance from the outlet aperture 55 increases, so that the light distributed across the height of the rib 81 is scattered into the beverage container 22 and illuminates the contents thereof in a visible manner through the insulating glass pane 17.

REFERENCE CHARACTERS

1 Door subassembly
2 Body
3 Axis
4 Door
5 Cover
6 Window pane
7 Frame
8 Limb
9 Limb
10 Limb
11 Limb
12 Handle recessed portion
13 Central piece
14 Outer wall
15 Inner wall
16 Hollow space
17 Insulating glass pane
18 Handle groove
19 Projection
20 Dispenser recess
21 Storage compartment
22 Beverage container
22' Lower face of beverage container
23 Recess
24 Actuation lever
25 Valve
26 Housing
27 Front face
28 Opening
29 Upper face
30 Container lower part
31 Lid
32 Rear wall
33 Aperture
34 Printed circuit board
35 LED
36 Base
37 Axis
38 First lever arm
39 Second lever arm
39' Upper face of second lever arm
39" Lower face of second lever arm
40 Cut-out
41 Finger
42 Screw dome
43 Recessed portion
44 Narrow face
45 Rib
46 Upper light exit
46' Lower light exit
47 Optical waveguide
48 Optical waveguide
49 Inlet aperture
50 Coating
51 Hollow space
52 Upper wall
53 Lower wall

54 Hole
55 Outlet aperture
56 Axle pin
57 Side wall
58 Housing
59 Opening
60 Molded part
61 Projection
62 Planar surface
63 Lateral flank
64 Indentation
65 Groove
66 Front face
67 Through-passage
68 Notch
69 Groove
70 Upper wall
71 Edge
72 Recessed portion
73 Base plate
74 Rib
75 Upper end
76 Facet
77 Coating
78 External layer
79 Internal layer
80 Side wall
81 Rib
82 Edge

The invention claimed is:

1. A beverage dispenser, comprising:

a housing having a dispenser recess formed therein and a rear wall;

an actuation lever mounted in said dispenser recess in such a way as to be able to pivot about an axis, said actuation lever having a light exit;

at least one illuminator disposed on said rear wall covered by said actuation lever;

at least one optical waveguide extending from said illuminator for illuminating said dispenser recess, said optical waveguide connecting said illuminator to said light exit of said actuation lever;

a base mounted on said rear wall, said actuation lever is articulated on said base and said optical waveguide is fastened to said base, said base being a hollow body opening toward said rear wall of said housing, said hollow body having a wall with an edge facing said rear wall and at least one recessed portion formed therein toward said edge, said recessed portion being open on said edge thereof, and said optical waveguide is inserted from said edge into said recessed portion.

2. The beverage dispenser according to claim 1, wherein said optical waveguide and said base are integrally molded from a transparent material.

3. The beverage dispenser according to claim 1, wherein said actuation lever has a rough surface, said light exit and said rough surface oppose one another on two sides of said actuation lever.

4. The beverage dispenser according to claim 1, wherein said actuation lever has a first lever arm which extends downwardly from the axis and a second lever arm which protrudes from the axis into said dispenser recess.

5. The beverage dispenser according to claim 4, wherein said second lever arm has a lower face with a lower light exit.

6. The beverage dispenser according to claim 5, wherein said first lever arm is illuminated via said lower light exit.

7. The beverage dispenser according to claim 4, wherein said actuation lever is formed from a translucent material provided with an opaque coating and said opaque coating has a hole formed therein functioning as said light exit.

8. The beverage dispenser according to claim 7, wherein said opaque coating has an internal layer and an external layer, said internal layer is brighter than said external layer.

9. The beverage dispenser according to claim 7, wherein said second lever arm is hollow and said optical waveguide terminates in a hollow space of said second arm spaced apart from said light exit.

10. The beverage dispenser according to claim 7, wherein said translucent material is exposed on an edge of said first lever arm facing the axis, and said optical waveguide terminates opposite said edge.

11. The beverage dispenser according to claim 5, wherein said first lever arm has a base plate and a rib which protrudes from said base plate and said rib extends from an end of said optical waveguide to said lower light exit.

12. A beverage dispenser, comprising:

a housing having a dispenser recess formed therein and a rear wall;

an actuation lever mounted in said dispenser recess in such a way as to be able to pivot about an axis, said actuation lever having a light exit, a first lever arm extending downwardly from the axis and a second lever arm protruding from the axis into said dispenser recess, said first lever arm having has at least one lower light exit formed therein;

at least one illuminator disposed on said rear wall covered by said actuation lever;

at least one optical waveguide extending from said illuminator for illuminating said dispenser recess, said optical waveguide connecting said illuminator to said light exit of said actuation lever; and a base mounted on said rear wall, said actuation lever is articulated on said base and said optical waveguide is fastened to said base.

13. The beverage dispenser according to claim 12, wherein said first lever arm is plate-shaped and has a plate, said lower light exit extends along an edge of said plate of said first lever arm or is disposed at a central point of said first lever arm.

14. A beverage dispenser, comprising:

a housing having a dispenser recess formed therein and a rear wall;

an actuation lever mounted in said dispenser recess in such a way as to be able to pivot about an axis, said actuation lever having a light exit, a first lever arm extending downwardly from the axis and a second lever arm protruding from the axis into said dispenser recess;

at least one illuminator disposed on said rear wall covered by said actuation lever;

at least one optical waveguide extending from said illuminator for illuminating said dispenser recess, said optical waveguide connecting said illuminator to said light exit of said actuation lever;

a base mounted on said rear wall, said actuation lever is articulated on said base and said optical waveguide is fastened to said base; and said second lever arm having an upper face and one of said upper face or said base having an upper light exit.

15. The beverage dispenser according to claim 14, further comprising a disposable beverage container being illuminated via said upper light exit.

16. The beverage dispenser according to claim 15, wherein said disposable beverage container has a wall and said upper light exit is aligned with said wall of said disposable beverage container.

* * * * *